US009022550B2

(12) United States Patent
Nagashima

(10) Patent No.: US 9,022,550 B2
(45) Date of Patent: May 5, 2015

(54) IMAGE FORMING DEVICE WITH CUTTER UNIT

(71) Applicant: Seiko Epson Corporation, Tokyo (JP)

(72) Inventor: Yutaka Nagashima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 56 days.

(21) Appl. No.: 13/849,041

(22) Filed: Mar. 22, 2013

(65) Prior Publication Data

US 2013/0271545 A1 Oct. 17, 2013

(30) Foreign Application Priority Data

Apr. 11, 2012 (JP) ..... 2012-090274

(51) Int. Cl.
*B41J 2/01* (2006.01)
*B41J 11/70* (2006.01)
*B41J 11/66* (2006.01)

(52) U.S. Cl.
CPC ..... *B41J 11/70* (2013.01); *B41J 11/663* (2013.01)

(58) Field of Classification Search
None
See application file for complete search history.

(56) References Cited

U.S. PATENT DOCUMENTS

| | | | | |
|---|---|---|---|---|
| 5,790,168 | A * | 8/1998 | Sano et al. | 347/262 |
| 2006/0098071 | A1 * | 5/2006 | Tanabe | 347/101 |
| 2009/0226236 | A1 * | 9/2009 | Yamashita et al. | 400/621 |
| 2010/0150632 | A1 * | 6/2010 | Matsumoto et al. | 399/395 |
| 2011/0048266 | A1 * | 3/2011 | Crystal et al. | 101/483 |

FOREIGN PATENT DOCUMENTS

| | | |
|---|---|---|
| JP | 2003-266831 | 9/2003 |
| JP | 2007-190812 | 8/2007 |

* cited by examiner

*Primary Examiner* — Geoffrey Mruk
*Assistant Examiner* — Bradley Thies
(74) *Attorney, Agent, or Firm* — Workman Nydegger

(57) ABSTRACT

An ink jet printer includes a liquid ejection head that forms an image on a roll paper which is transported from upstream to downstream of a transportation path, and a cutter unit that cuts the roll paper on which the image is formed by the liquid ejection head straight in the direction transverse to the transportation direction of the roll paper, wherein the cutter unit is configured to be capable of changing the cutting direction of the roll paper.

5 Claims, 5 Drawing Sheets

IMAGE FORMING DEVICE WITH CUTTER UNIT

BACKGROUND

1. Technical Field

The present invention relates to image forming devices such as an ink jet printer.

2. Related Art

Generally, ink jet printers are known as a type of image forming device. These printers supply ink to a recording head and eject the supplied ink onto a sheet of paper through nozzles of a recording head so as to perform printing of images. JP-A-2007-190812 discloses a printer that successively prints images on a strip of roll paper that is transported along a transportation path and then cuts the strip of roll paper into each image.

JP-A-2007-190812 discloses a printer that uses the roll paper (sheet) on which a cutting line is printed in advance. In this printer, an optical sensor reads the cutting line so that the roll paper is cut along the cutting line by using a cutter. When the roll paper is displaced in the right or left direction during cutting, an abutting member abuts against the roll paper from one of the right and left sides to the other, thereby correcting the position of the roll paper so as to align the cutting line with the cutting direction.

When the roll paper is fed in a skewed manner and the cutting line is printed skewed with respect to the roll paper, the printer disclosed in JP-A-2007-190812 is not capable of cutting the roll paper in the width direction which is perpendicular to the transportation direction since the cutting direction of the cutter is fixed.

Such a problem exists not only in the above ink jet printer, but also in image forming devices having a cutter unit for cutting a sheet on which an image is formed.

SUMMARY

An advantage of some aspects of the invention is that an image forming device capable of cutting the sheet on which an image is formed in a desired direction is provided.

According to an aspect of the invention, the image forming device includes an image forming unit that forms an image on a sheet which is transported from upstream to downstream of a transportation path, and a cutter unit that cuts the sheet on which the image is formed by the image forming unit straight in a direction transverse to a transportation direction of the sheet, wherein the cutter unit is configured to be capable of changing the cutting direction of the sheet.

Generally, when the sheet which is transported is skewed to the transportation path, the image formed on the sheet is skewed to the sheet. In this embodiment, since the cutting direction of the sheet by the cutter unit can be changed, even if the sheet is fed in a skewed manner, the sheet can be cut aligned with the image formed on the sheet, or alternatively, the sheet can be cut in the width direction of the sheet which is perpendicular to the transportation direction regardless of the orientation of the image. That is, the sheet on which the image is formed can be cut in the desired direction.

According to the above aspect of the invention, the image forming device includes a cutting direction changing unit that changes the cutting direction of the sheet by the cutter unit, and a detector that detects a skew of the sheet which is transported, and a control unit that controls an operation of the cutting direction changing unit based on the detection result of the detector.

Accordingly, since the control unit controls the operation of the cutting direction changing unit based on the detection result of the detector, the sheet can be cut aligned with the skew by using the cutter unit.

According to the above aspect of the invention, the image forming device includes a selection unit that is capable of selecting whether to align the cutting direction of the sheet with the skew of the sheet when the skew of the sheet is detected by the detector.

Accordingly, the selection unit can select whether to align the cutting direction of the sheet with the skew of the sheet.

In the image forming device according to the above aspect of the invention, the image forming unit is a liquid ejection head that forms an image by ejecting a liquid onto the sheet while moving in a scan direction that is perpendicular to a transportation path of the sheet, and the cutting direction of the sheet by the cutter unit is defined by taking a direction along the scan direction as a reference direction.

Accordingly, since the cutting direction of the sheet by the cutter unit is defined by taking the scan direction of the liquid ejection head as the reference direction, the cutting direction of the sheet can be aligned with the image formed on the sheet with high accuracy.

In the image forming device according to the above aspect of the invention, when the selection unit selects not to align the cutting direction of the sheet with the skew of the sheet, the cutting direction of the sheet by the cutter unit is aligned with the reference direction.

Accordingly, when the selection unit selects not to align the cutting direction of the sheet with the skew of the sheet, the cutting direction of the sheet by the cutter unit can be aligned with the image formed on the sheet.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
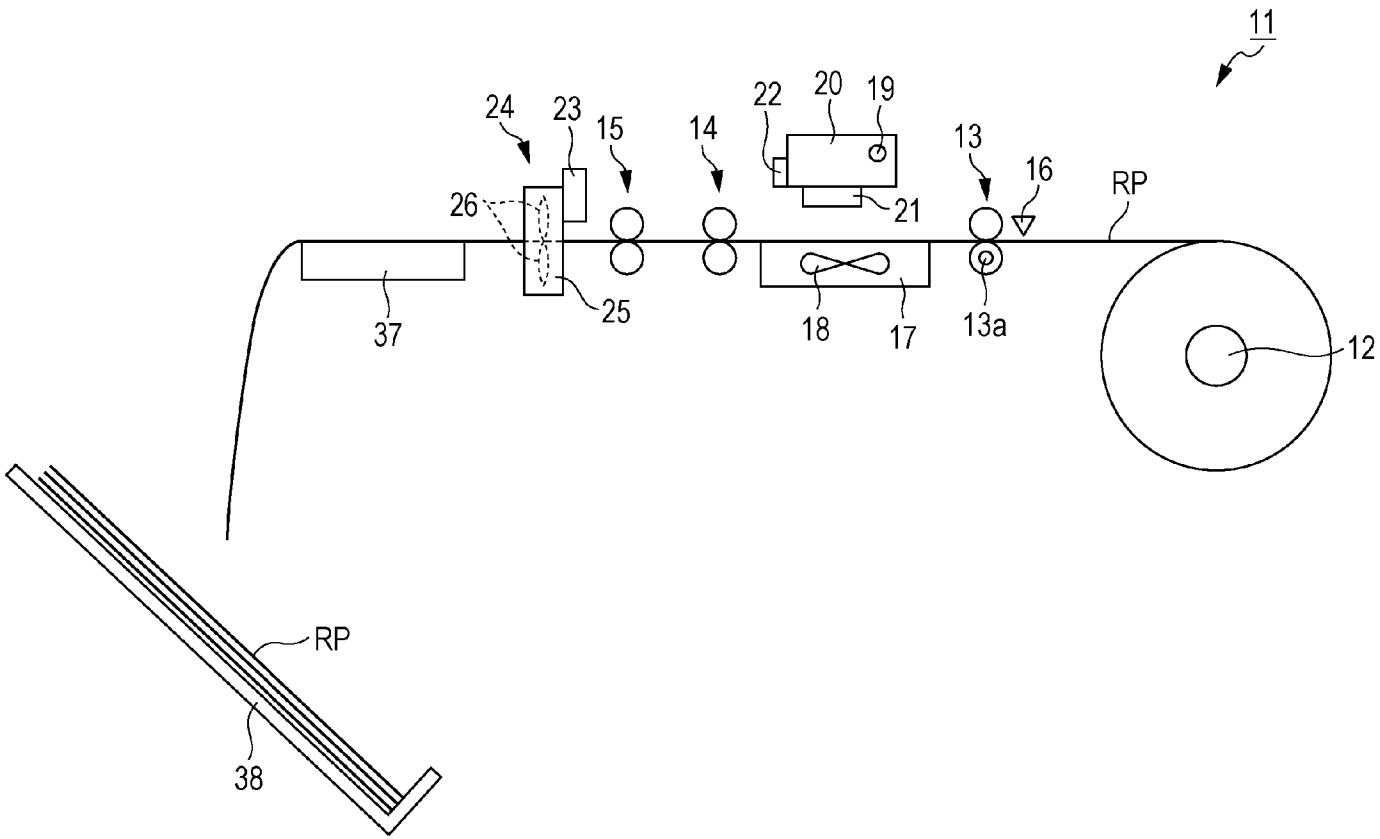
FIG. 1 is a schematic view which shows a configuration of an ink jet printer according to an embodiment.

An embodiment of the invention in which an image forming device is implemented as an ink jet printer will be described below with reference to the drawings. As shown in FIG. 1, an ink jet printer 11 as an image forming device includes a spindle 12 that rotatably supports a roll of strip sheet of a roll paper RP. The ink jet printer 11 further includes a plurality of (in this embodiment, three) pairs of rollers 13 to 15, each of which is composed of upper and lower rollers. The spindle 12 is disposed upstream of the transportation path of the roll paper RP, and as the spindle 12 rotates, the roll paper RP is unwound from the roll and transported downstream along the transportation path by the pairs of rollers 13 to 15.

The pairs of rollers 13 to 15, which are the pair of feeding rollers 13, the pair of advancing rollers 14 and the pair of transportation rollers 15, are disposed along the transportation path of the roll paper RP in sequence from upstream to downstream, with a space from each other as appropriate. Each of the pairs of rollers 13 to 15 are rotatable about a shaft that extends in the width direction of the roll paper RP which is perpendicular to the transportation direction.

In each pair of rollers 13 to 15, the lower roller is rotated to cause the upper roller to rotate. As the pairs of rollers 13 to 15 rotate, the roll paper RP that is unwound from the spindle 12 is transported downstream along the transportation path while being held between each of the pairs of rollers 13 to 15. The lower roller of the pair of rollers 13 is provided with a first rotary encoder 13*a*.

A paper edge sensor 16 is disposed at a position immediately upstream of the pair of feeding rollers 13 in the transportation path of the roll paper RP so as to detect the edge of the roll paper RP that is unwound from the spindle 12. A support table 17 in a cuboid shape is disposed between the pair of feeding rollers 13 and the pair of advancing rollers 14 so as to support the underside of the roll paper RP that is transported along the transportation path.

A suction fan 18 is rotatably mounted inside the support table 17. As the suction fan 18 rotates, the roll paper RP that is transported on the support table 17 is suctioned through a plurality of suction holes (not shown in the figure) formed on the upper wall of the support table 17 and adsorbed on the support table 17. A guide shaft 19 that extends in the width direction of the roll paper RP which is perpendicular to the transportation direction is disposed at a position opposite the support table 17 with respect to the transportation path of the roll paper RP.

A carriage 20 is supported on the guide shaft 19 so as to reciprocate along the guide shaft 19. A liquid ejection head 21 as an image forming unit is supported on the lower end of the carriage 20. The liquid ejection head 21 reciprocates with the carriage 20 in a scan direction (the direction along the guide shaft 19) which is perpendicular to the transportation path of the roll paper RP while ejecting ink from a plurality of nozzles (not shown in the figure) onto the roll paper RP that is supported on the support table 17, thereby forming an image G (see FIG. 2). Further, a paper width sensor 22 is supported on a surface of the carriage 20 on the downstream in the transportation direction of the roll paper RP so as to detect the both ends of the roll paper RP in the width direction.

Figure 2:
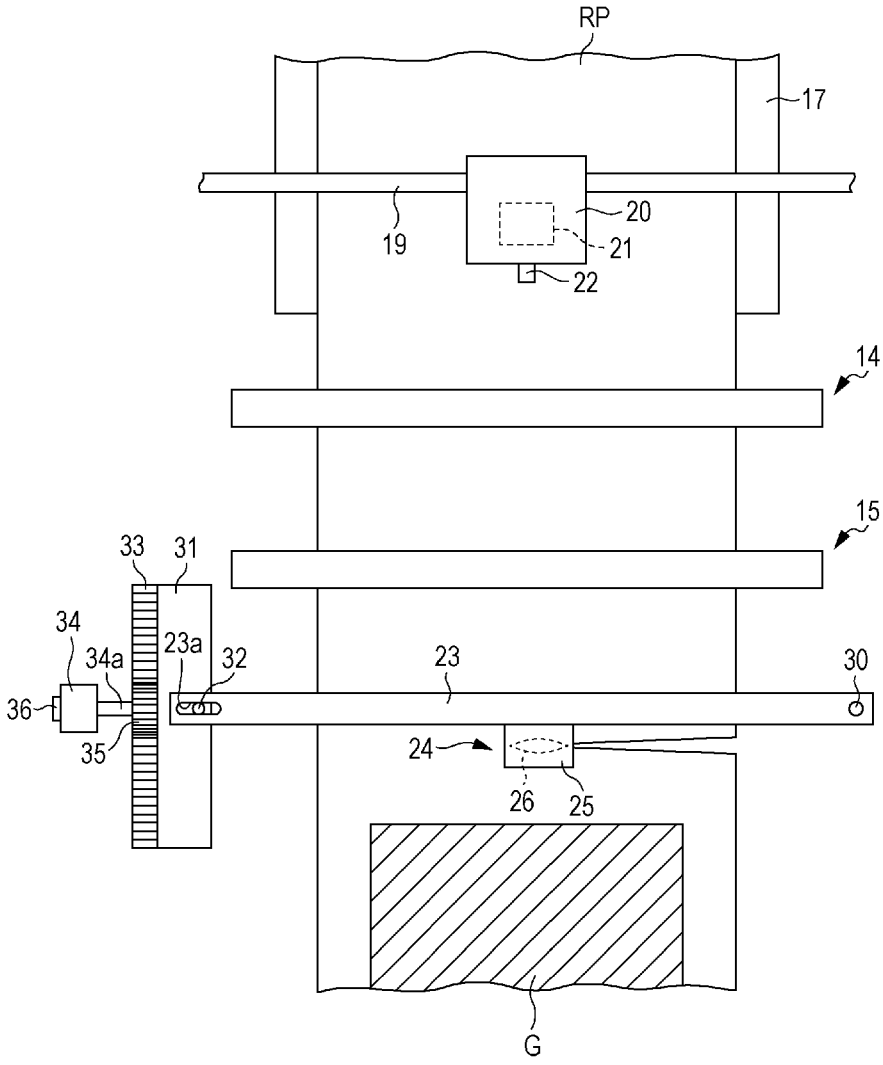
FIG. 2 is a schematic enlarged plan view of an essential part of FIG. 1.

As shown in FIGS. 1 and 2, a guide frame 23 that extends in the width direction of the roll paper RP (the direction parallel to the guide shaft 19) is disposed at a position downstream of the pair of transportation rollers 15 in the transportation path of the roll paper RP. The length of the guide frame 23 is longer than the maximum width of the roll paper RP.

A cutter unit 24 is supported on the guide frame 23 so as to reciprocate along the guide frame 23. The cutter unit 24 cuts the roll paper RP straight in the width direction of the roll paper RP by each image G which has been formed by the liquid ejection head 21.

The cutter unit 24 includes a cutter carriage 25 that is supported on the guide frame 23 so as to reciprocate along the guide frame 23, and a pair of upper and lower rotary blades 26 that is rotatably supported on the cutter carriage 25. When the cutter carriage 25 moves along the guide frame 23 in one direction from one end (the right side in FIG. 2) in the width direction of the roll paper RP to the other end (the left side in FIG. 2), the roll paper RP is cut by a shearing force of the both rotary blades 26.

That is, the roll paper RP is cut straight by moving the cutter carriage 25 straight along the guide frame 23, thereby moving the both rotary blade 26 from the cutting starting position on one end of the roll paper RP in the width direction to the other end which is opposite of the cutting starting position. Accordingly, the direction in which the guide frame 23 extends serves as a cutting direction of the roll paper RP by the cutter unit 24.

As shown in FIG. 2, one end (the right end in FIG. 2) of the guide frame 23 is swingably supported by a shaft 30 that extends in the up and down direction (the direction perpendicular to the plane of FIG. 2) which is perpendicular to a transportation surface of the roll paper RP (the surface parallel to the plane of FIG. 2), while the other end (the left end in FIG. 2) of the guide frame 23 is supported on a support plate 31 which is formed as a rectangular plate that extends in the transportation direction of the roll paper RP.

Further, a projection 32 is formed on the support plate 31 at the end on the side of the roll paper RP at the center in the transportation direction of the roll paper RP. The projection 32 is slidably inserted through an oblong 23*a* which is formed on the other end (the left end in FIG. 2) of the guide frame 23.

A rack 33 that extends in the transportation direction of the roll paper RP is disposed on the support plate 31 at the end opposite from the roll paper RP. The rack 33 mates with the gear 35 that is formed at the distal end of the output shaft 34*a* of a feeding motor 34. The feeding motor 34 is provided with a second rotary encoder 36 that detects a rotation amount of the feeding motor 34.

When the gear 35 rotates in the forward or backward direction by drive of the feeding motor 34, the support plate 31 slidingly moves upstream or downstream in the transportation path of the roll paper RP. As the support plate 31 slidingly moves, the guide frame 23 swings about the shaft 30 in parallel to the transportation surface of the roll paper RP.

Since the direction in which the guide frame 23 extends serves as the cutting direction of the roll paper RP by the cutter unit 24, the swing of the guide frame 23 changes the cutting direction of the roll paper RP by the cutter unit 24. Further, the cutting direction of the roll paper RP by the cutter unit 24 when the guide frame 23 is parallel to the guide shaft 19 is defined by taking the direction that corresponds to the image G formed on the roll paper RP (the direction along the scan direction of the liquid ejection head 21) as the reference direction.

In this embodiment, the feeding motor 34 and the support plate 31 constitute a cutting direction changing unit. As shown in FIG. 1, a support member 37 in a cuboid shape is disposed at a position downstream of the cutter unit 24 in the transportation path of the roll paper RP so as to support the underside of the roll paper RP that is cut by the cutter unit 24. Further, an output sheet tray 38 formed as an L-shaped plate is disposed under the support member 37 so as to receive the roll papers RP that is cut by the cutter unit 24 and falls from the downstream end of the support member 37 and support the roll papers RP stacked in the output sheet tray 38.

In this configuration, since the roll paper RP hangs from the downstream end of the support member 37 before the roll paper RP is cut by the cutter unit 24, a pulling force in the downstream direction due to the gravity (weight of the hanging roll paper RP) is applied to the roll paper RP.

Figure 3:
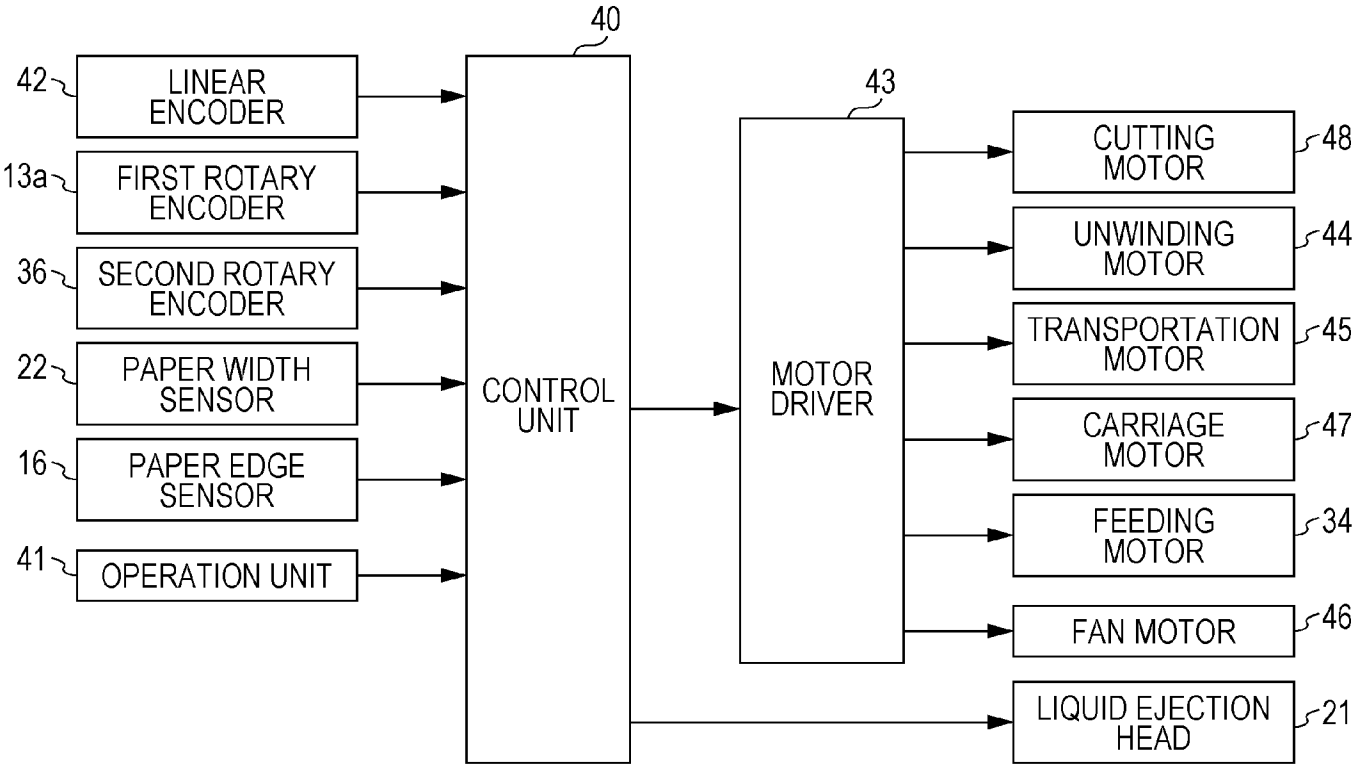
FIG. 3 is a block diagram which shows an electric configuration of the ink jet printer.

An electric configuration of the ink jet printer 11 will be described below. As shown in FIG. 3, the ink jet printer 11 includes a control unit 40 that integrally controls the operation of the ink jet printer 11 and an operation unit 41 through which the user can input the type of the roll paper RP to be used, the resolution of the image G printed (formed) on the roll paper RP or the number of sheets to be printed.

An input interface (not shown in the figure) of the control unit 40 is electrically connected to the operation unit 41, the rotary encoders 13*a*, 36, the paper edge sensor 16, the paper width sensor 22, and a linear encoder 42 that is mounted on the carriage 20 and detects the movement distance of the carriage 20.

An output interface (not shown in the figure) of the control unit 40 is electrically connected to the liquid ejection head 21. Further, the output interface is electrically connected via a motor driver 43 to an unwinding motor 44 that rotates the spindle 12, a transportation motor 45 that rotates each of the pairs of rollers 13 to 15 and a fan motor 46 that rotates the suction fan 18.

The output interface (not shown in the figure) of the control unit 40 is also electrically connected via a motor driver 43 to a carriage motor 47 that reciprocates the carriage 20 along the guide shaft 19 and a cutting motor 48 that serves as a driving source to move the cutter carriage 25 along the guide frame 23 while rotating the rotary blades 26.

The control unit 40 controls ejection of ink from the liquid ejection head 21 based on the signals from the encoders 13*a*, 36, 42, the sensors 16, 22 and the operation unit 41, and also controls drive of the motors 34, 44 to 48 via the motor driver 43.

Further, the control unit 40 obtains the width of the roll paper RP by calculating the movement distance of the carriage 20 based on the counted pulse signals from the linear encoder 42 in the period between when one end of the roll paper RP in the width direction is detected by the paper width sensor 22 and when the other end of the roll paper RP is detected during movement of the carriage 20.

The control unit 40 detects skew of the roll paper RP based on the counted number of signals from the paper width sensor 22 and the pulse signals from the linear encoder 42. Accordingly, the control unit 40, the paper width sensor 22 and the linear encoder 42 constitute a detector that detects skew of the roll paper RP.

Specifically, the paper width sensor 22 detects the position of one end of the roll paper RP in the width direction by moving the carriage 20 to the roll paper RP which remains at the same position. Then, after the roll paper RP is transported by a specific distance D, the paper width sensor 22 again detects the position of one end of the roll paper RP in the width direction.

The control unit 40 obtains a specific distance D based on the counted number of pulse signals from the first rotary encoder 13*a*. Then, the control unit 40 judges that the roll paper RP is skewed if there is a difference between the positions of one end of the roll paper RP in the width direction before and after the roll paper RP is transported by a specific distance D based on the signals from the linear encoder 42, and judges that the roll paper RP is not skewed if there is no difference between those positions.

When the control unit 40 judges that the roll paper RP is skewed, the control unit 40 calculates the skew of the roll paper RP, in which side in the width direction of the roll paper RP and to what extent the roll paper RP is skewed to the normal transportation path, from the positions of one end of the roll paper RP in the width direction before and after the roll paper RP is transported by a specific distance D based on the counted number of pulse signals from the linear encoder 42.

Then, the control unit 40 controls drive of the feeding motor 34 based on the counted number of pulse signals from the second rotary encoder 36 so that the guide frame 23 swings to align with the skew of the roll paper RP, thereby aligning the cutting direction with the skew of the roll paper RP.

The operation unit 41 is configured such that the user can select whether to align the cutting direction of the roll paper RP by the cutter unit 24 with the skew of the roll paper RP by operating the operation unit 41 when the control unit 40 judges that the roll paper RP is skewed. Accordingly, the operation unit 41 serves as a selecting unit that is capable of selecting whether to align the cutting direction of the roll paper RP by the cutter unit 24 with the skew of the roll paper RP.

An operation of the ink jet printer 11 will be described below. First, a printing operation with the cutting direction by the cutter unit 24 being aligned with the skew of the roll paper RP will be described. That is, in this printing operation of the roll paper RP, the user selects to align the cutting direction of the roll paper RP by the cutter unit 24 with the skew of the roll paper RP by operating the operation unit 41 when the roll paper RP is skewed.

In this printing operation, when the spindle 12 and each of the pairs of rollers 13 to 15 are rotated, the roll paper RP is unwound from the spindle 12 downstream along the transportation path. The roll paper RP unwound from the spindle 12 is transported on the support table 17 by the pair of feeding rollers 13. Then, ink is ejected onto the roll paper RP that is supported on the support table 17 from the liquid ejection head 21 that reciprocates along the guide shaft 19 (in the scan direction) so as to form (print) the image G.

When skew of the roll paper RP is detected, the guide frame 23 swings to align with the skew of the roll paper RP. That is, as shown in FIG. 4, the guide frame 23 swings about the shaft 30 by drive of the feeding motor 34 so as to extend in the width direction of the skewed roll paper RP.

Then, the roll paper RP on which the image G is formed is transported downstream on the support table 17 by the pair of advancing rollers 14 and the pair of transportation rollers 15. During this transportation, the image G is angled relative to the skewed roll paper RP. After a portion of the roll paper RP in which the image G is formed passes the cutter unit 24, the transportation of the roll paper RP stops. At this point, since the roll paper RP hangs from the downstream end of the support member 37, a pulling force in the downstream direction due to the gravity is applied to the roll paper RP.

Figure 4:
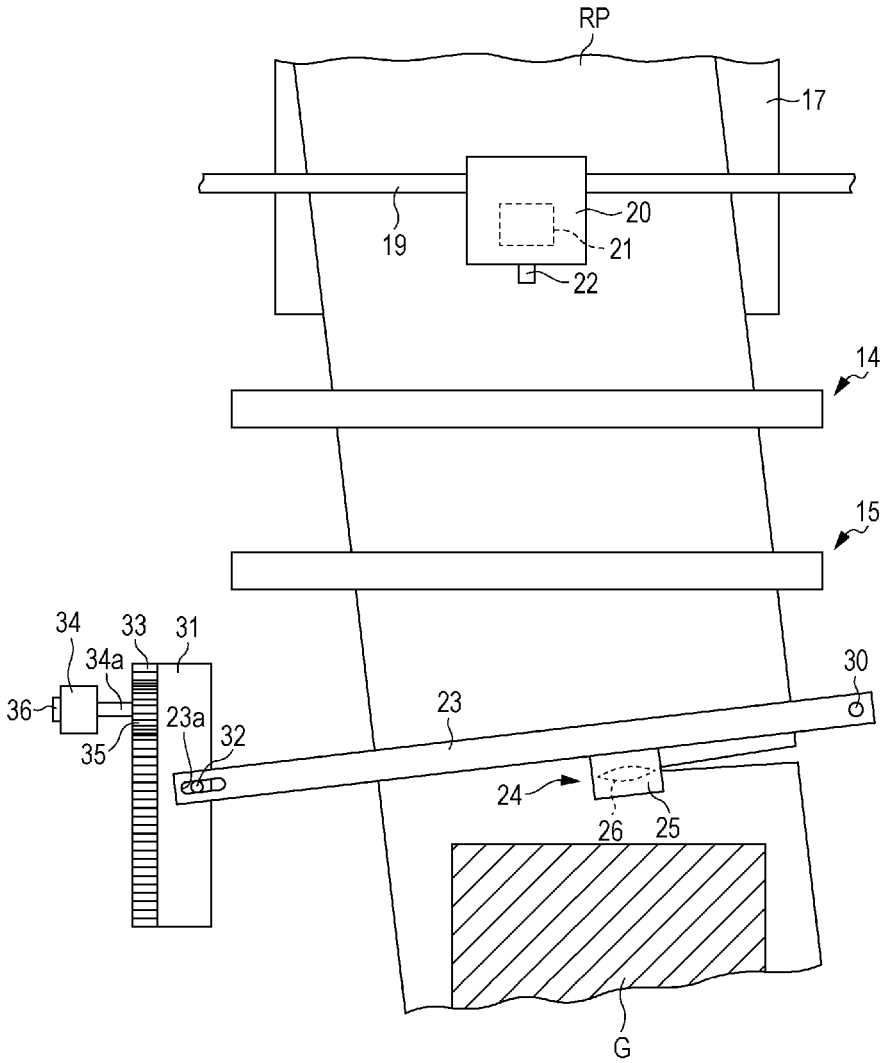
FIG. 4 is a schematic enlarged plan view of an essential part of the ink jet printer which shows that, when a roll paper is fed in a skewed manner, the roll paper is cut aligned with the skew.

As shown in FIG. 4, when the cutter carriage 25 moves along the guide frame 23 from one end (the right side in FIG. 4) in the width direction of the roll paper RP to the other end (the left side in FIG. 4) while rotating the rotary blades 26, the roll paper RP is cut by the rotary blades 26. Since the roll paper RP is cut in the width direction, the roll paper RP is separated into rectangular (or square) shaped roll papers RP.

The rectangular shaped roll papers RP that have been cut by the rotary blades 26 (the portion of the roll paper RP downstream from the cutting position) falls from the downstream end of the support member 37, and the roll papers RP staked in sequence are supported on the output sheet tray 38.

Although the image G on the separated roll paper RP on the output sheet tray 38 is skewed by the amount of skew of the roll paper RP, the cutting direction of the roll paper RP is aligned with the skew of the roll paper RP. This printing operation is generally selected when the image G is a CAD drawing or the like so that the user can fold the separated roll papers RP for ease of storage.

Next, a printing operation without the cutting direction by the cutter unit 24 being aligned with the skew of the roll paper RP will be described. That is, in this printing operation of the roll paper RP, the user selects not to align the cutting direction of the roll paper RP by the cutter unit 24 with the skew of the roll paper RP by operating the operation unit 41 when the roll paper RP is skewed.

In this printing operation, when the spindle 12 and each of the pairs of rollers 13 to 15 are rotated, the roll paper RP is unwound from the spindle 12 downstream along the transportation path. The roll paper RP unwound from the spindle 12 is transported on the support table 17 by the pair of feeding rollers 13. Then, ink is ejected onto the roll paper RP that is supported on the support table 17 from the liquid ejection head 21 that reciprocates along the guide shaft 19 (in the scan direction) so as to form (print) the image G.

Figure 5:
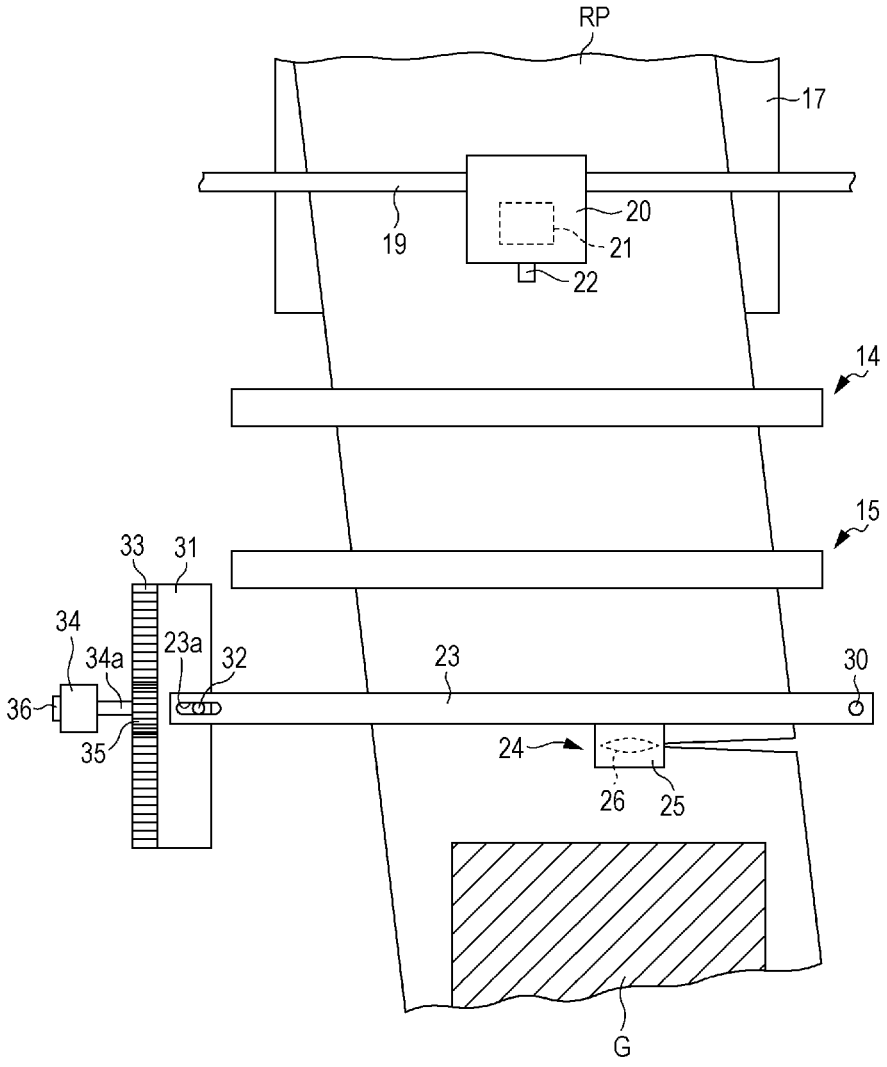
FIG. 5 is a schematic enlarged plan view of an essential part of the ink jet printer which shows that, when a roll paper is fed in a skewed manner, the roll paper is cut aligned with an image.

When skew of the roll paper RP is detected, the guide frame 23 swings to become parallel with the guide shaft 19. That is, as shown in FIG. 5, the guide frame 23 swings about the shaft 30 by drive of the feeding motor 34 to align with the image G formed on the skewed roll paper RP. In other words, the guide frame 23 swings about the shaft 30 by taking the cutting direction of the roll paper RP by cutter unit 24 as the reference direction.

Then, the roll paper RP on which the image G is formed is transported downstream on the support table 17 by the pair of advancing rollers 14 and the pair of transportation rollers 15. During this transportation, the image G is angled relative to the skewed roll paper RP. After a portion of the roll paper RP in which the image G is formed passes the cutter unit 24, the transportation of the roll paper RP stops. At this point, since the roll paper RP hangs from the downstream end of the support member 37, a pulling force in the downstream direction due to the gravity is applied to the roll paper RP.

As shown in FIG. 5, when the cutter carriage 25 moves along the guide frame 23 from one end (the right side in FIG. 5) in the width direction of the roll paper RP to the other end (the left side in FIG. 5) while rotating the rotary blades 26, the roll paper RP is cut by the rotary blades 26. Since the roll paper RP is cut along the image G formed on the roll paper RP, the roll paper RP is separated into parallelogram (or rhombus) shaped roll papers RP.

The parallelogram shaped roll papers RP that have been cut by the rotary blades 26 (the portion of the roll paper RP downstream from the cutting position) falls from the downstream end of the support member 37, and the roll papers RP staked in sequence are supported on the output sheet tray 38. Although the image G on the separated roll paper RP on the output sheet tray 38 is skewed by the amount of skew of the roll paper RP, the cutting direction of the roll paper RP is aligned with the image G formed on the roll paper RP, not with the skew of the roll paper RP. This printing operation is generally selected when the image G is a photograph or the like.

According to the above embodiment, the following effect can be achieved:

(1) Generally, when the roll paper RP which is transported is skewed to the transportation path, the image G formed on the roll paper RP is skewed to the roll paper RP. In this embodiment, since the cutting direction of the roll paper RP by the cutter unit 24 can be changed, even if the roll paper RP is fed in a skewed manner, the roll paper RP can be cut aligned with the image G formed on the roll paper RP, or alternatively, the roll paper RP can be cut in the width direction of the roll paper RP which is perpendicular to the transportation direction regardless of the orientation of the image G. That is, even if the roll paper RP is fed in a skewed manner, the roll paper RP can be cut in the desired direction of the user.

(2) Since the control unit 40 controls drive of the feeding motor 34 based on the detection result of the skew of the roll paper RP, the cutting direction of the roll paper RP by the cutter unit 24 can be aligned with the skew of the roll paper RP. Accordingly, the roll paper RP can be cut aligned with the skew by using the cutter unit 24.

(3) When the roll paper RP is fed in a skewed manner, the user can select whether to align the cutting direction of the roll paper RP by the cutter unit 24 with the skew of the roll paper RP by operating the operation unit 41.

(4) Since the cutting direction of the roll paper RP by the cutter unit 24 is defined by taking the direction along the scan direction of the liquid ejection head 21 as the reference direction, the cutting direction of the roll paper RP can be aligned with the image G formed on the roll paper RP with high accuracy.

(5) In the case where the user selects not to align the cutting direction of the roll paper RP with the skew of the roll paper RP by operating the operation unit 41 when the roll paper RP is fed in a skewed manner, the cutting direction of the roll paper RP by the cutter unit 24 is aligned with the reference direction. Accordingly, in the case where the user selects not to align the cutting direction of the roll paper RP with the skew of the roll paper RP by operating the operation unit 41 when the roll paper RP is fed in a skewed manner, the cutting direction of the roll paper RP by the cutter unit 24 can be aligned with the image G formed on the roll paper RP.

MODIFIED EXAMPLES

The above embodiment may be modified as follows:

In the case where the user selects not to align the cutting direction of the roll paper RP with the skew of the roll paper RP by operating the operation unit 41 when the roll paper RP is fed in a skewed manner, the cutting direction of the roll paper RP by the cutter unit 24 is not necessarily aligned with the reference direction.

The cutting direction of the roll paper RP by the cutter unit 24 is not necessarily defined by taking the direction along the scan direction of the liquid ejection head 21 as the reference direction.

The user may not select whether to align the cutting direction of the roll paper RP by the cutter unit 24 with the skew of the roll paper RP when the roll paper RP is fed in a skewed manner.

The guide frame 23 may be configured to swing by a manual operation. In this manner, the cutting direction of the roll paper RP by the cutter unit 24 can be freely manually changed.

The cutter unit may be scissors of a so-called guillotine-type cutting machine.

A single blade may be used instead of the rotary blade 26.

The sheet may be a plastic film, cloth or foil instead of the roll paper RP.

The image forming device may be a facsimile machine, copy machine, or scanner machine instead of the ink jet printer 11.

Although the image forming device is embodied as the ink jet printer 11 in the above embodiment, a liquid ejection apparatuses that eject liquid other than ink may be used. The invention may be applied to a variety of liquid ejection apparatuses having a liquid ejection head that ejects fine liquid droplets. The liquid droplets refer to a state of liquid that is ejected from the liquid ejection apparatuses and are intended to include those in a particle, tear drop or string shape. The liquid as described herein may be any material that can be ejected from liquid ejection apparatuses. For example, it may include a material in liquid phase such as liquid having high or low viscosity, sol, gel water, other inorganic solvent, organic solvent and liquid solution, and a material in melted state such as liquid resin and liquid metal (molten metal). Further, in addition to a material in a liquid state, it may include particles of functional material made of solid substance such as pigment and metal particles, which is dissolved, dispersed or mixed in a solvent. Further, typical examples of liquid include ink as mentioned above, liquid crystal and the like. The ink as described herein includes various liquid components such as general water-based ink, oil-based ink, gel ink and hot melt ink. Specific examples of liquid ejection apparatus may include, for example, liquid ejection apparatuses that eject liquid containing materials such as electrode material and color material in a dispersed or dissolved state, which are used for manufacturing of liquid crystal displays, electro-luminescence (EL) displays, surface emitting displays or color filters. Alternatively, they may include liquid ejection apparatuses that eject bioorganic materials used for manufacturing biochips, liquid ejection apparatuses that are used as a precision pipette and eject liquid of a sample, textile printing apparatuses and micro dispensers. Further, they may also include liquid ejection apparatuses that eject lubricant to precision instrument such as a clock or camera in a pin-point manner, liquid ejection apparatuses that eject transparent resin liquid such as ultraviolet cured resin onto a substrate for manufacturing minute hemispheric lenses (optical lenses) used for optical communication elements or the like, and liquid ejection apparatuses that eject acid or alkali etching liquid for etching a substrate or the like. The invention may be applied to any one of the above-mentioned liquid ejection apparatuses.

The entire disclosure of Japanese Patent Application No. 2012-090274, filed Apr. 11, 2012, is expressly incorporated by reference herein.

What is claimed is:

1. An image forming device comprising:

an image forming unit that forms an image on a sheet which is transported from upstream to downstream of a transportation path;

a pivotal guide frame extending across the sheet in a direction transverse to the transportation direction and being pivotal upstream and downstream in the transportation path;

a shaft connected to a first end of the pivotal guide frame, the shaft extending beyond a width of the sheet;

a support plate connected to a second end of the pivotal guide frame and also connected to a motor that causes the pivotal guide frame to pivot, the support plate extending beyond a width of the sheet; and a cutter unit that moves along the pivotal guide frame and cuts the sheet on which the image is formed by the image forming unit straight in a direction transverse to a transportation direction of the sheet and is movable in the transverse direction across a width of the sheet, wherein the cutter unit is configured to be capable of changing the cutting direction of the sheet.

2. The image forming device according to claim 1, further comprising:

a cutting direction changing unit that changes the cutting direction of the sheet by the cutter unit;

a detector that detects a skew of the sheet which is transported; and a control unit that controls an operation of the cutting direction changing unit based on the detection result of the detector.

3. The image forming device according to claim 2, further comprising a selection unit that is capable of selecting whether to align the cutting direction of the sheet with the skew of the sheet when the skew of the sheet is detected by the detector.

4. The image forming device according to claim 3, wherein the image forming unit is a liquid ejection head that forms an image by ejecting a liquid onto the sheet while moving in a scan direction that is perpendicular to a transportation path of the sheet, and the cutting direction of the sheet by the cutter unit is defined by taking a direction along the scan direction as a reference direction.

5. The image forming device according to claim 4, wherein, when the selection unit selects not to align the cutting direction of the sheet with the skew of the sheet, the cutting direction of the sheet by the cutter unit is aligned with the reference direction.

* * * * *